US007339107B2

(12) United States Patent
Remignanti

(10) Patent No.: US 7,339,107 B2
(45) Date of Patent: Mar. 4, 2008

(54) METHOD OF AND SYSTEM FOR CONTROLLING AUDIO EFFECTS

(75) Inventor: Jesse Martin Remignanti, Arlington, MA (US)

(73) Assignee: Source Audio LLC, Woburn, MA (US)

( * ) Notice: Subject to any disclaimer, the term of this patent is extended or adjusted under 35 U.S.C. 154(b) by 151 days.

(21) Appl. No.: 11/145,872

(22) Filed: Jun. 6, 2005

(65) Prior Publication Data

US 2006/0272489 A1 Dec. 7, 2006

(51) Int. Cl.
*G10H 1/02* (2006.01)

(52) U.S. Cl. ..... 84/737; 84/723; 84/735; 84/738

(58) Field of Classification Search ..... None
See application file for complete search history.

(56) References Cited

U.S. PATENT DOCUMENTS 6,150,947 A * 11/2000 Shima ..... 340/692
6,995,310 B1 * 2/2006 Knapp et al. ..... 84/722
2003/0196542 A1 * 10/2003 Harrison, Jr. ..... 84/737
2004/0200338 A1 * 10/2004 Pangrle ..... 84/724
2005/0109197 A1 * 5/2005 Garrett et al. ..... 84/726
2006/0060068 A1 * 3/2006 Hwang et al. ..... 84/615
2006/0107822 A1 * 5/2006 Bowen ..... 84/612

* cited by examiner

*Primary Examiner*—Marlon T Fletcher
(74) *Attorney, Agent, or Firm*—Chapin IP Law, LLC; Barry W. Chapin, Esq.

(57) ABSTRACT

An audio effects control for and method of controlling the application of special audio effects applied to an audio signal, comprises a sensor configured to sense movement associated with the generation of the audio signal, wherein the sensor produces a control signal in response to detecting the movement, and the control signal is transmitted to an audio effects unit to control application of an audio effect on an audio signal.

47 Claims, 4 Drawing Sheets

METHOD OF AND SYSTEM FOR CONTROLLING AUDIO EFFECTS

TECHNICAL FIELD

This disclosure relates to applying special audio effects to sounds produced, for example, by musical instruments and, more particularly, to controlling the application of such audio effects.

BACKGROUND

As a musician or performer plays an instrument during a concert or other type of performance, a song may call for or it may be desirable to apply one or more special audio effects to musical notes produced by the instrument. To apply the effect, audio signals from the instrument are sensed (e.g., with a microphone, pickup, etc.) and sent to a signal processor that may be dedicated to applying such effects to the audio signals. After the one or more audio effects are applied by the signal processor, the processed audio signals are usually conditioned (e.g., amplified, filtered, etc.) and provided to speakers or other type of output device. To initiate the application of the audio effects, the person (playing the instrument) typically steps on a foot-pedal that is located on stage near the person. However, to trigger the application of the audio effects on stage, the musician must first locate the foot-pedal and then step on the pedal in a manner as to not look awkward or out of step with the song being played.

SUMMARY OF THE DISCLOSURE

In accordance with an aspect of the disclosure, an audio effects control is configured to include a sensor that senses movement, for example, a change in position, orientation, acceleration or velocity of the sensor. For example, by mounting the sensor to a musical instrument, the movement may be the sensed movement associated with playing a musical instrument. Alternatively, by securing the sensor to the person playing the instrument the sensor will sense movement of part of the person to which the sensor is secured. The sensor produces an electrical signal in response to detecting the movement, or change in position or orientation, and the electrical signal is sent to an audio effects unit to control application of one or more audio effects on audio signals produced by the musical instrument. The sensor can be secured to any other item for which movement or position or orientation of the sensor can be initiated and/or controlled.

The sensor may be configured to sense any one or several phenomena. For example, the sensor may be configured to sense acceleration of the musical instrument (with the aid, for example, of an accelerometer), velocity, or alternatively a position change of the musical instrument (with the aid, for example, of a gyroscope). The position change sensed by the sensor may include any movement, or a prescribed movement such as the musical instrument or a portion of the instrument rotating about an axis or translating along an axis.

Various types of electrical signals may be produced by the sensor. For example, the electrical signal may be an analog signal and may be modulated for transmission from the sensor. An electrical circuit may also be provided for conditioning the electrical signal. The audio effects control also includes an audio effects unit which is responsive to the signal generated by the sensor. The electrical circuit may convert the electrical signal into a digital signal prior to transmission to the audio effects unit. The electrical circuit may also convert the electrical signal into a musical instrument digital interface (MIDI) signal.

In various embodiments, sensing movement may include sensing acceleration of a portion of the musical instrument, sensing acceleration of a portion of a person playing the musical instrument, sensing a rotation of a portion of the musical instrument and/or sensing a rotation of a portion of a person playing the musical instrument, or sensing a translation of a portion of the musical instrument and/or sensing a translation of a portion of a person playing the musical instrument.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE EMBODIMENTS

Figure 1:
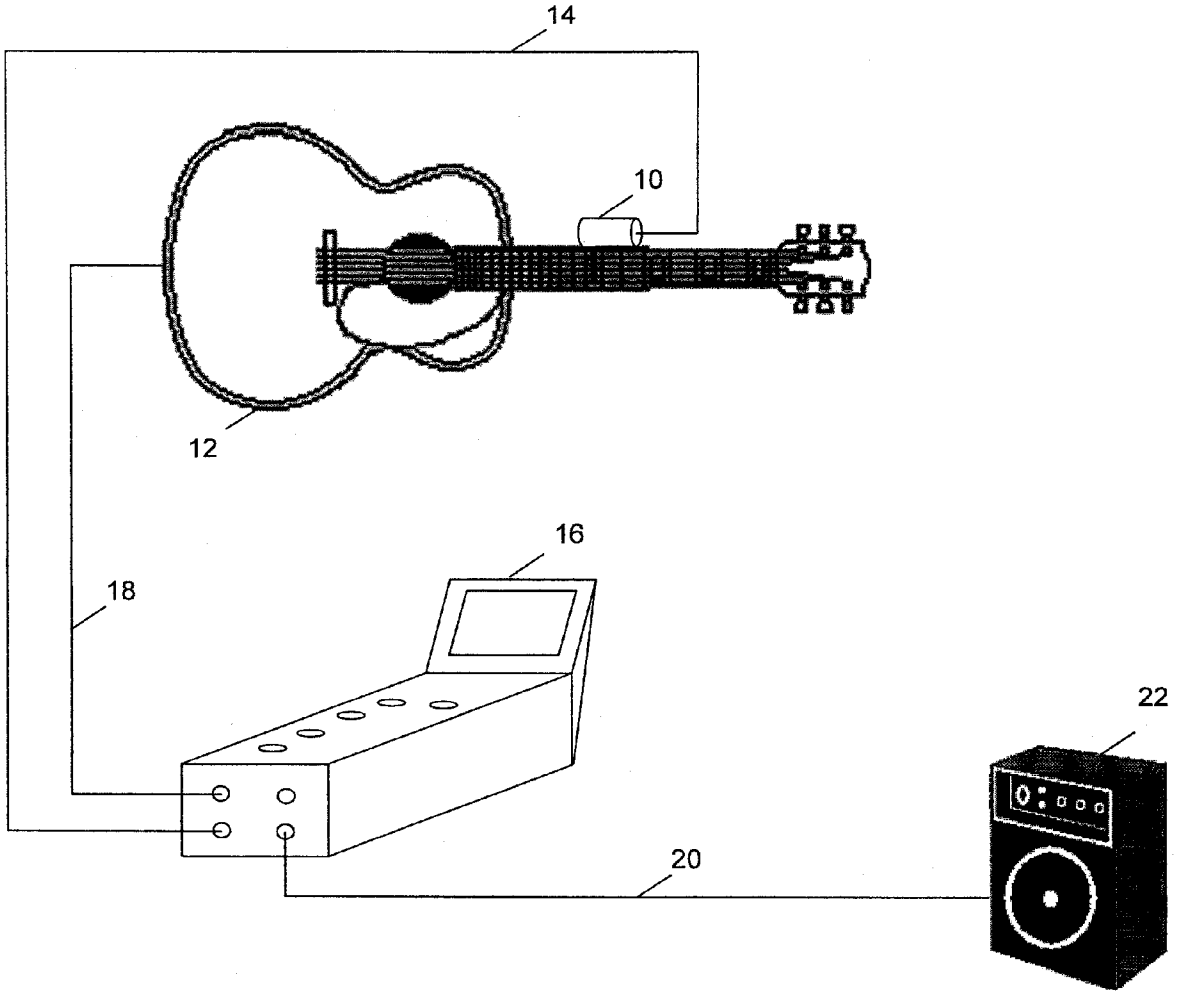
FIG. 1 is a diagrammatic view of one embodiment of an audio signal processing system that includes an instrument-mounted sensor that controls the application of audio effects to audio signals produced by a musical instrument.

Referring to FIG. 1, one embodiment of the disclosed system includes a sensor 10 mounted to a guitar 12 so that the sensor is capable of sensing movements, or alternatively the position, change in position, orientation, and/or change in orientation of the guitar. Based on the sensed movement or position or orientation of the guitar, and specifically sensor 10, a signal is produced by sensor 10 and provided over a cable or wires 14 to an audio effects unit 16. Along with the signals from sensor 10, audio effects unit 16 also receives audio signals that are produced by guitar 12, and provided, for example, over a cable or wires 18 to audio effects unit 16. Various types and combinations of audio effects may be applied by audio effects unit 16 to the audio signals produced by guitar 12. For example, the audio signals may be amplified, attenuated, distorted, reverberated, time-delayed, up or down mixed into other frequency bands, or applied ith other similar effects known to one skilled in the art of conditioning audio signals so as to produced audio effects. Also, while guitar 12 is shown for producing audio signals, sensor 10 may be mounted to one or a combination of other types of musical instruments. For example, other types of string instruments (e.g., bass guitar, cello, violin, viola, etc.), brass instruments (e.g. trumpets, saxophones, etc.), woodwind instruments (e.g., clarinets, etc.), percussion instruments, keyboard instruments, or other types of instruments or collections of instruments may be used to produce audible signals. Further, the term musical instrument also includes devices that sense vocal signals. For example, sensor 10 may be mounted onto a microphone so as to sense the movement, orientation or position of the microphone. By detecting the movement, position or orientation of the microphone, a signal produced by sensor 10 may be used to control the application of audio effects to the audio signals (e.g., vocal signals) received by the microphone.

When playing the instrument, a musician may intentionally move guitar 12 in a particular manner such that sensor 10 senses the movement and sends a control signal over cable 14 to audio effects unit 16. Upon receiving the control signal, one or more predefined special audio effects are applied in a controlled manner to the audio signals that are provided over cable 18 from guitar 12. The control signal from sensor 10 may provide various types of control to the application of the audio effects. For example, the control signal may initiate the application of one or more audio effects. By providing this trigger from the control signal, the musician is free to apply an effect from any location rather than e.g., having to seek out and step on a foot-pedal. Other types of audio effect control may be provided by the control signal. For example, rather than providing a discrete trigger signal to initiate (or halt) application of one or more effects, a variable control signal (analog or digital) may be produced by sensor 10. The variable signal may be used to dynamically control various aspects of the audio effects. For example, the variable control signal may be used to adjust the resonant frequency of an audio effect or other similar parameter.

In this illustrative example, after the audio effects are applied, the audio signals are sent over a cable 20 to an amplifier/speaker 22 that broadcasts the signals. As suggested, to halt the application of the audio effects, in some arrangements the musician may intentionally move guitar 12 in another manner such that the movement is detected by the sensor 10. Based on the detected movement, another trigger signal is sent over cable 14 to audio effects unit 16. Upon receiving this second trigger signal, application of the audio effects may be halted or different audio effects may be applied. Alternatively, the audio effects may last a predetermined time period before ending. In another arrangement the audio effects may continue until a cue is provided from the music, e.g., there is a pause or halt in the music, or a particular note is played. In addition, one or more of the audio effects applied to the music can be applied in a fade in and/or fade out fashion.

Figure 2:
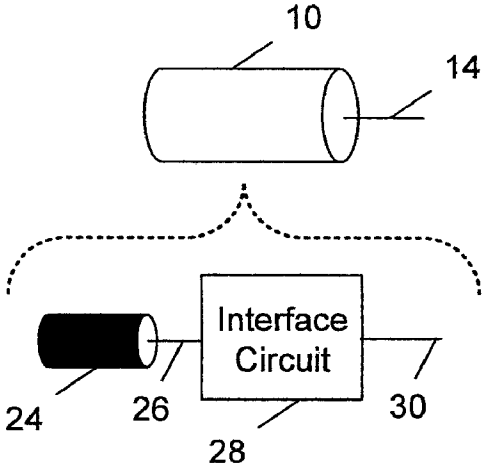
FIG. 2 is a diagrammatic view of the sensor shown in FIG. 1.

Referring to FIG. 2, the contents of sensor 10 includes a sensing device 24 that senses the movement of the sensor (and correspondingly the movement of guitar 12). Various sensing techniques known to one skilled in the art of transducers may be implemented in sensing device 24. In one example, sensing device 24 may include an accelerometer that senses acceleration (i.e., rate of change of velocity with respect to time) in one or more directions, and produces an electrical signal as a function of the sensed acceleration. Alternatively or in addition, one or more gyroscopes may also be included in sensing device 24. By including an inertial device such as a gyroscope, a change in attitude (e.g., pitch rate, roll rate, and yaw rate) of sensor 10 may be detected and an electrical signal produced as a function of the sensed attitude change. Other types of sensors that detect change in position, change in velocity, or change in acceleration may be included in sensing device 24. For example, a pressure sensor (e.g., piezoelectric sensor, ceramic sensor, etc.) mounted on guitar 12 or incorporated into a pick used to play guitar 12 may be used as a sensing device. Sensor 10 may also include multiple sensing devices. For example, one sensing device may be dedicated for detecting motion along one axis and another sensing device may be dedicated for detecting motion along a second axis of rotation.

As illustrated in FIG. 2, sensing device 24 is preferably connected (via a conductor 26) to an interface circuit 28 that prepares the electrical signal produced by the sensing device for transmission. For example, interface circuit 28 may include circuitry for filtering, amplifying, or performing other similar functions on the electrical signal provided over conductor 26. In this example, once the electrical signal is conditioned for transmission, a conductor 30 provides the conditioned signal to cable 14 for delivery to audio effects unit 16. Besides using hard-wire connections to provide the signal to audio effects unit 16, other signal transmission techniques known to one of skill in the art of electronics and telecommunications may be implemented. For example, interface circuit 28 may include wireless technology such as a wireless transmitter or transceiver for transmitting the signals produced by sensing device 24 over a wireless link. Various types of wireless technology, such as radio frequency (RF), infrared (IR), etc., may be implemented in interface circuit 28 and the audio effects unit 16. Furthermore, in some arrangements a combination of hard-wire and wireless technology may be implemented in interface circuit 28 and audio effects unit 16. Interface circuit 28 may also include circuitry configured and arranged so as to transfer the signals into another domain. For example, an analog signal produced by sensing device 24 may be converted into a digital signal by an analog-to-digital converter included in interface circuit 28. Modulation techniques may also be provided by interface circuit 28. For example, the signals produced by the sensing device 24 may be amplitude, phase, frequency, and/or polarization modulated in the analog or digital domain. In one particular example, the signals produced by interface circuit 28 are pulse-width modulated. Interface circuit 28 may encode the signals that are transmitted to audio effects unit 16. For example, the signals may be encoded to comply with particular formats such as the musical instrument digital interface (MIDI) format. In one implementation, movement sensed by sensing device 24 may be translated into MIDI control signals for bending pitch or modulating the audio signal from the instrument. By producing these control signals from the sensing device, e.g., effects are controlled through the movement of sensing device 24 rather than using the common pitch bend and modulation knobs on a synthesizer.

Figure 3:
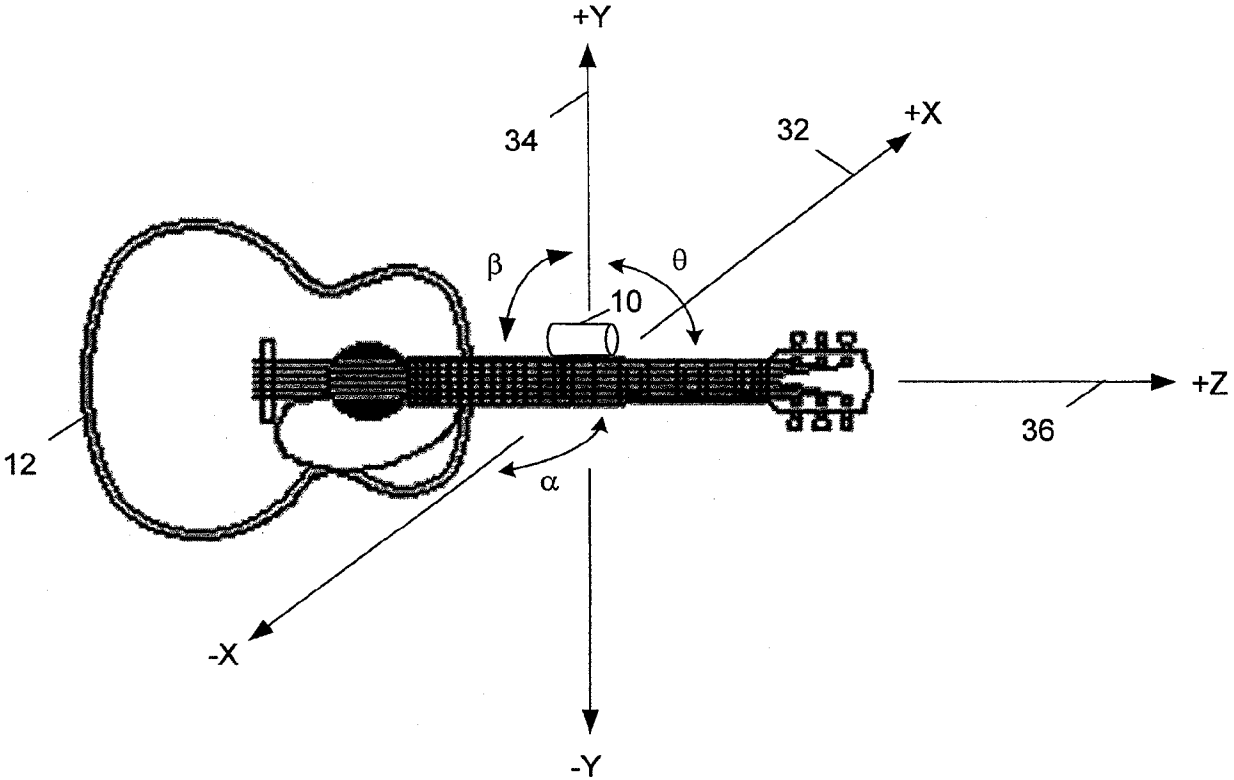
FIG. 3 illustrates possible detectable movements of the instrument shown in FIG. 1.

Referring to FIG. 3, one set of potential movements of guitar 12 that might be sensed by sensor 10 and initiate signal generation by the sensor are illustrated as an example of how the system operates. To assist the illustration, three axes 32, 34, and 36 are shown in a right-handed rectangular coordinate system. In this example, sensor 10 is capable of sensing rotation of guitar 12 about any one of axes 32, 34, or 36. For example, if guitar 12 is "pitched" about axis 32 (as represented by angle $\theta$) a signal is produced by sensor 10 and is transmitted to audio effects unit 16. Guitar 12 may also be "rolled" about axis 36 (as represented by angle $\beta$) or "yawed" about axis 34 (as represented by angle $\alpha$) and a signal is produced by sensor 10.

Along with detecting the rotation of guitar 12, other movements may be sensed and initiate generation of a electrical signal by sensor 10. For example, sensor 10 may include a gyroscope or other device for sensing the orientation of the sensor, or the sensor 10 may be capable of sensing translation of the guitar. By incorporating a global positioning system (GPS) receiver in sensor 10, for example, a signal may be produced as the position of the guitar changes as the musician moves. A laser system may also be incorporated into sensor 10 to sense position changes of the guitar relative to one or more reflective surfaces (e.g., a polished floor, wall, ceiling, etc.).

By sensing these rotational, orientation and/or translational changes, the signals produced by sensor 10 may be used by audio effects unit 16 to control the application of one or more audio effects to the musical tones produced by guitar 12. For example, the performer may intentionally move the guitar to apply an audio effect known as a "wah-wah" effect. This type of effect is generated by sweeping the resonant frequency of a filter (which may be included in audio effects unit 16). As guitar 12 changes position, the corresponding signals produced by sensor 10 controls the application of the audio effect. For example, guitar 12 may initially be oriented downward (in the "−y" direction) along axis 34 and the signal produced by sensor 10 controls the application of the audio effect at to the low resonant frequency (e.g., 200 Hz) of the filter. As guitar 12 is rotated toward an upward vertical position (oriented in the "+y" direction) along axis 34, the signals produced by sensor 10 controls the application of the audio effect across the frequency spectrum of the filter to an upper resonant frequency (e.g., 4000 Hz). This "wah-wah" effect (or another effect) may also be applied as guitar 12 is rotated about any of the axes (e.g. axis 32, 34, or 36) shown in the figure. Also, sensor 10 may control the application of this effect as guitar 12 is translated (e.g., carried by the performer across a stage), or the orientation of the guitar is changed, or otherwise moved so that the sensor responds.

Figure 4:
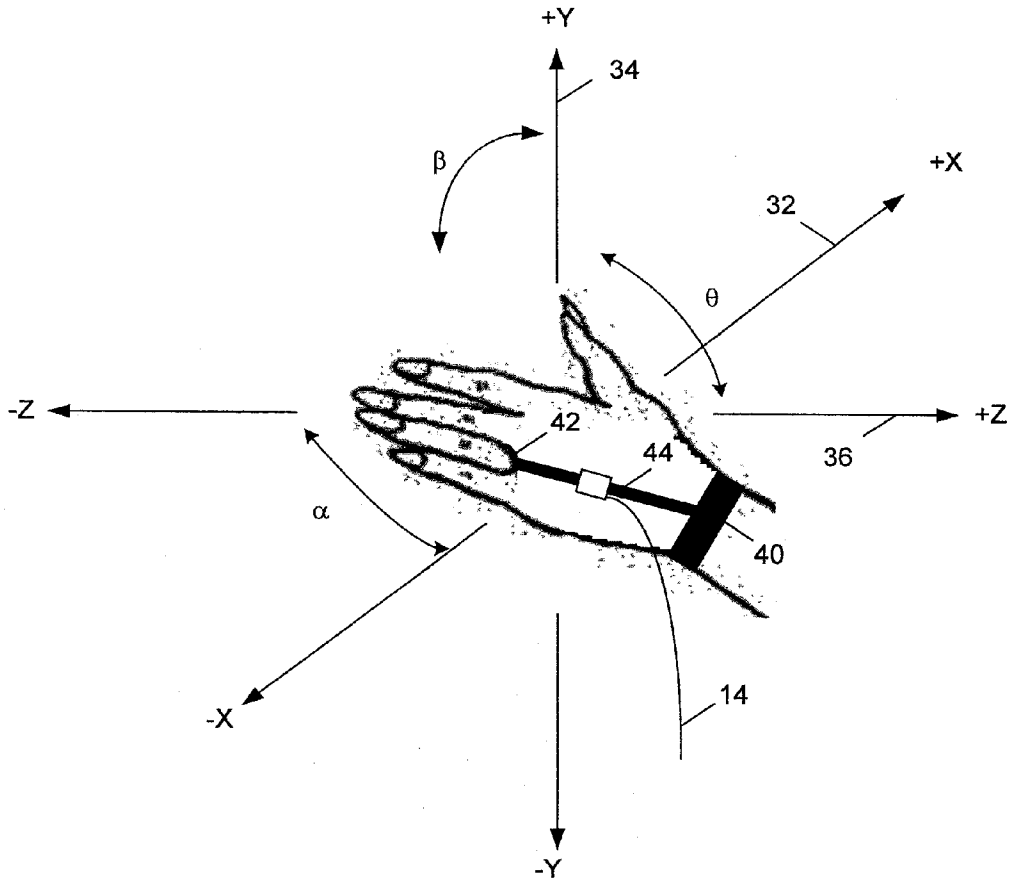
FIG. 4 is a diagrammatic view of one embodiment of a sensor designed and configured to be hand-mounted so as to control the application of audio effects to audio signals produced by a musical instrument with movement of the hand.

Along with or in lieu of attaching sensor 10 to the instrument (e.g. guitar 10), one or more sensors may also be attached to the performer playing the instrument. An example is shown in FIG. 4. In this arrangement, sensor 10 is attached to the back of the performer's hand 38. To hold sensor 10 in place and not interfere with the musician's playing of guitar 12, a wrist strap 40 and a figure loop 42 provide tie points to the musician's hand 38. Sensor 10 is attached to a strap 44 that is respectively connected between wrist strap 40 and figure loop 42. Various types of material may be used to produce wrist strap 40, figure loop 42, and strap 44. For example, flexible material such as neoprene or nylon may be used for hold sensor 10. Other types of attachment mechanisms known to one skilled in the art of clothing design or clothing accessories may be implemented to secure sensor 10 to the musician.

While sensor 10 is attached to the performer in the illustrated FIG. 4, and not the instrument, the sensor functions in a similar manner. In the example shown in FIG. 4, changes in position, velocity, acceleration, and/or orientation of the musician's hand may be detected and used to produce a control signal. The signal may be used to control the application of audio effects by audio effects unit 16. Similar to detecting movements of an instrument, with sensor 10 attached to the musician's hand, various hand movements may be detected. For example, a control signal may be produced if the performer rotates his or her hand about axis 32 (as represented by angle $\theta$), or about axis 34 (as represented by angle $\alpha$), or about axis 36 (as represented by angle $\beta$).

By attaching sensor 10 to the performer, movement may be better controlled. For example, the performer may trigger a "wah-wah" audio effect by pointing his or her hand toward the ground (along the "−y" direction of axis 34) to apply of the audio effect at the low resonant frequency (e.g., 200 Hz) of a filter. Then, the performer may rotate his or her arm about axis 32 and point their hand toward the ceiling (along the "+y" direction of axis 34). While making this motion, signals produced by sensor 10 may control the application of the audio effect across the frequency spectrum of the filter to the upper resonant frequency (e.g., 4000 Hz). Other types of audio effects may also be controlled based on the motion of the musician's hand.

In the illustrated example of FIG. 4, the signals generated by sensor 10 are provided to audio effects unit 16 over cable 14. However, wireless circuitry (e.g., RF, IR, etc.) may be implemented into sensor 10 to remove the need for cable 14 and increase the mobility of the performer as he or she plays guitar 12 (or another instrument).

While this example described attaching sensor 10 to the musician's hand, in other arrangements, the sensor may be attached elsewhere to the musician. For example, sensor 10 may be incorporated into an arm-band or attached to a piece of the musician's clothing or costume. Additionally, multiple sensors may be attached to the musician for producing multiple signals that may be used to control the application of one or more audio effects by audio effects unit 16. By incorporating one or more of these sensors onto the performer or onto the instrument played by the performer, musical performances are improved since the performer is free to move anywhere on stage and trigger the application of audio effects.

A number of implementations have been described. Nevertheless, it will be understood that various modifications may be made. For example, prescribed movements of the sensor are described as producing the control signal for producing the audio effect. It is also possible to have multiple sensors for producing different audio effects. A system can also be provided wherein different prescribed movements of a sensor can produce different audio effects. Further, while audio effect unit 16 is shown as a standalone unit, it may be connected to a computerized system, or alternatively be embodied as a software program run entirely on a computerized system. As such the signals generated by the sensor or sensors would be received by the computerized system and processed by the system before the signals are generated so as to drive one or more loudspeakers, such as speaker 22 in the illustrated embodiment shown in FIG. 1. Accordingly, other implementations are within the scope of the following claims.

What is claimed is:

1. An audio effects control for controlling the application of special audio effects applied to an audio signal, comprising:

a sensor configured to sense movement associated with generation of the audio signal, wherein the sensor is configured to produce a control signal in response to detecting the movement and transmit the control signal to an audio effects unit to control application of an audio effect on the audio signal; and the control signal configured to apply a wah-wah audio effect to the audio signal in response to the movement of the sensor.

2. The audio effects control of claim 1, wherein the sensor includes an accelerometer.

3. The audio effects control of claim 1, wherein the sensor includes a gyroscope.

4. The audio effects control of claim 1, wherein the sensor is mounted to a musical instrument that generates the audio signal.

5. The audio effects control of claim 1, wherein the sensor is attached to portion of a musician playing a musical instrument that generates the audio signal.

6. The audio effects control of claim 5, wherein the sensor is attached to the hand of a musician playing the musical instrument.

7. The audio effects control of claim 1, wherein the sensor is configured and positioned to sense acceleration as the musical instrument is moved.

8. The audio effects control of claim 1, wherein the sensor is configured and positioned to sense a position change of the musical instrument.

9. The audio effects control of claim 8, wherein the position change includes rotating the musical instrument about an axis.

10. The audio effects control of claim 8, wherein the position change includes translating the musical instrument along an axis.

11. The audio effects control of claim 1, wherein the sensor is configured and positioned to sense acceleration of sensor configured to be secured to a musician playing the musical instrument.

12. The audio effects control of claim 1, wherein the sensor is configured and positioned to sense a position change of the sensor configured to be secured to a musician playing the musical instrument.

13. The audio effects control of claim 12, wherein the position change includes a portion of the musician rotating about an axis.

14. The audio effects control of claim 12, wherein the position change includes a portion of the musician translating along an axis.

15. The audio effects control of claim 1, wherein the control signal is an analog signal.

16. The audio effects control of claim 1, wherein the control signal is a modulated signal.

17. The audio effects control of claim 1, further comprising:

an electrical circuit configured to condition the electrical signal sent to the audio effects unit.

18. The audio effects control of claim 17, wherein the electrical circuit is configured to convert the electrical signal into a digital signal prior to transmission to the audio effects unit.

19. The audio effects control of claim 17, wherein the electrical circuit is configured to convert the electrical signal into a musical instrument digital interface (MIDI) signal.

20. A method of controlling the application of an audio effect on an audio signal, comprising:

sensing movement of a sensor while the audio signal is being generated;

producing a signal representative of the sensed movement; and transmitting the signal to an audio effects unit so as to control application of an audio effect applied to the audio signal, the application of the audio effect including sweeping a resonant frequency of a filter between a high frequency and a low frequency in accordance with the movement to produce the audio effects on the signal.

21. A method as in claim 20 further comprising:

generating the signal to sweep to the high resonant frequency of the filter in response to detecting movement of the sensor in a first direction.

22. The method of claim 20, wherein sensing movement of the sensor includes sensing acceleration of a portion of a musical instrument producing the audio signals and to which the sensor is secured.

23. The method of claim 22, wherein sensing movement includes sensing acceleration of the sensor secured to a portion of a person playing a musical instrument producing the audio signals.

24. The method of claim 20, wherein sensing movement of the sensor includes sensing a rotation of a portion of a musical instrument producing the audio signals and to which the sensor is secured.

25. The method of claim 20, wherein sensing movement of the sensor includes sensing a rotation of the sensor secured to a portion of a person playing a musical instrument producing the audio signals.

26. The method of claim 20, wherein sensing movement of the sensor includes sensing a translation of a portion of a musical instrument producing the audio signals.

27. The method of claim 20, wherein sensing movement of the sensor includes sensing a translation of the sensor secured to a portion of a person playing a musical instrument producing the audio signals.

28. A method for producing an audio signal, the method comprising:

receiving a first signal;

detecting a modification signal produced from a motion activated sensor affixed to a moving portion of an individual;

modifying the first signal with the modification signal to produce a second signal;

producing an audio signal from the second signal;

in response to detecting that movement of the portion of the individual is in a first direction, producing a first modification signal causing modification of the first signal in accordance with a first pattern;

in response to detecting that movement of the portion of the individual is in a second direction, producing a second modification signal causing modification of the first signal in accordance with a second pattern; and wherein the first direction and the second direction are substantially opposite from each other and wherein the first pattern and second pattern modify the first signal in a substantially opposite manner.

29. A method comprising:

receiving an audio signal;

detecting a control signal produced by a sensor that monitors motion associated with a source originating the audio signal; and applying an audio effect to the audio signal in accordance with the control signal to modify the audio signal;

wherein detecting the control signal includes monitoring motion associated with the sensor, which is affixed to a musician originating the audio signal; and wherein applying the audio effect includes producing a wah-wah effect on the audio signal in accordance with detected motion associated with the sensor.

30. A method as in claim 29, wherein detecting the control signal includes detecting an orientation of the sensor, which is attached to a musician originating the audio signal.

31. A method as in claim 29, wherein detecting the control signal includes detecting an acceleration associated with the sensor, which is attached to a musician originating the audio signal.

32. A method as in claim 29, wherein detecting the control signal includes detecting motion associated with the sensor, which is attached to a musical instrument originating the audio signal.

33. A method as in claim 29, wherein detecting the control signal includes monitoring the sensor to detect motion associated with a musical instrument originating the audio signal.

34. A method as in claim 29, wherein detecting the control signal includes monitoring at least one of the following attributes associated with the sensor:

a) an acceleration parameter associated with the sensor, b) a position of the sensor in a three-dimensional space, c) an orientation of the sensor, d) rotation of the sensor about an axis, e) translation of the sensor along an axis, and f) velocity of the sensor.

35. A method as in claim 29, wherein detecting the control signal includes monitoring an output of the sensor to detect a respective motion associated with a microphone device originating the audio signal.

36. A method as in claim 29, wherein detecting the control signal includes monitoring the control signal to detect occurrence of a first discrete trigger signal produced by the sensor, the occurrence of the discrete trigger signal indicating to apply a first audio effect to the audio signal for purposes of producing an audible output.

37. A method as in claim 36, upon detecting an occurrence of a second trigger signal produced by the sensor, modifying application of the first audio effect to the audio signal for purposes of producing the audible output.

38. A method as in claim 37, wherein modifying application of the first respective audio effect to the audio signal includes terminating application of the first audio effect to the audio signal and applying a second audio effect to the audio signal for purposes of producing the audible output.

39. A method as in claim 36, upon detecting an occurrence of the first trigger signal, initiating application of the first audio effect to the audio signal for purposes of modifying the audio signal for a predetermined duration of time.

40. A method as in claim 29, wherein applying the audio effect to the audio signal includes at least one of: amplification, attenuation, distortion, reverberation, time delaying, up mixing, down mixing of the audio signal into other frequency bands for purposes of producing an audible output.

41. A method as in claim 29, wherein detecting the control signal includes detecting a range of motion associated with the sensor while the sensor is affixed to the source generating the audio-based signal; and wherein applying the audio effect includes applying a spectrum of different types of audio effects as the sensor is swept through the range of motion.

42. A method as in claim 29, wherein detecting the control signal includes detecting movement of the sensor in a first direction; and wherein applying the audio effect includes applying the audio signal to a filter set to a low resonant frequency in response to detecting the movement of the sensor in the first direction.

43. A method as in claim 29, wherein detecting the control signal includes detecting movement of the sensor in a second direction; and wherein applying the audio effect includes applying the audio signal to a filter set to a high resonant frequency in response to detecting the movement of the sensor in the second direction.

44. A method as in claim 41 further comprising:

in response to detecting the range of motion associated with the sensor, sweeping a resonant frequency of a filter between a high resonant frequency setting and a low resonant frequency setting in accordance with the movement to produce the wah-wah effect.

45. A method as in claim 44, wherein the high resonant frequency is around 4000 hertz and wherein the low resonant frequency is around 200 hertz.

46. A method as in claim 21 further comprising:

generating the signal to sweep to the low resonant frequency of the filter in response to detecting movement of the sensor in a second direction.

47. A method as in claim 44, wherein the first direction is an upward direction and the second direction is a downward direction with respect to an orientation of a musician producing the audio signal.

* * * * *